United States Patent [19]

Hasegawa

[11] 4,351,379

[45] Sep. 28, 1982

[54] METHOD OF REELING AND UNREELING A REINFORCED VENEER SHEET

[75] Inventor: Katsuji Hasegawa, Ohbu, Japan

[73] Assignee: Meinan Machinery Works, Inc., Ohbu, Japan

[21] Appl. No.: 218,828

[22] Filed: Dec. 22, 1980

[30] Foreign Application Priority Data

Dec. 28, 1980 [JP] Japan ..... 54-172310

[51] Int. Cl.[3] ..... B27D 1/00; B27D 5/00

[52] U.S. Cl. ..... 144/365; 428/58; 428/54; 144/353; 156/176; 156/192; 156/257; 156/304.3; 242/7.02

[58] Field of Search ..... 156/176, 166, 192, 257, 156/304.3; 144/309 W, 309 R, 318, 315; 428/58, 54; 242/7.02, 55, 67.3

[56] References Cited

U.S. PATENT DOCUMENTS 4,179,322 12/1979 Brown ..... 156/192
4,289,179 9/1981 Koba .

FOREIGN PATENT DOCUMENTS 33-6498 8/1958 Japan .
49-32052 8/1974 Japan .
54-3926 2/1979 Japan .

*Primary Examiner*—George F. Lesmes
*Assistant Examiner*—Alexander S. Thomas
*Attorney, Agent, or Firm*—Armstrong, Nikaido, Marmelstein & Kubovcik

[57] ABSTRACT

A method of reeling and unreeling a reinforced veneer sheet is provided. A veneer sheet peeled off from a log on the veneer lathe is subjected to a reinforcing step, in which an elongated cut is formed on one side of the sheet across the grain and a length of cord is embedded in it. In a reeling operation, the reinforced veneer sheet is wound onto the reel with its cut side facing radially outward. In an unreeling operation, on the other hand, the sheet is unwound from the roll with its cut side facing downward. This method prevents the embedded cord from slipping out of the engagement with the elongated cut during the reeling and unreeling operations.

4 Claims, 14 Drawing Figures

METHOD OF REELING AND UNREELING A REINFORCED VENEER SHEET

BACKGROUND OF THE INVENTION

The present invention relates to a method of reeling and unreeling reinforced veneer sheets. It is known to form elongated cuts in veneer sheets across the veneer grain and bury a cord or a string in the cuts for thereby preparing a train of interconnected veneer sheets. This process for providing cord-embedded veneer sheets is usable for various purposes such as reinforcing veneer sheets having cracks, joining veneer sheets containing defective portions, and joining neat veneer sheets which have the defective portions trimmed off. The present invention contemplates to provide an effective veneer sheet reeling and unreeling method by bringing such a reinforcing or joining process into cooperative relation with a process for winding the cord-embedded veneer sheets on a reel and a process for unwinding the same off the reel, thereby contributing a great deal to veneer processing in a plywood production line.

Typical proposals have heretofore been made concerning the cord burying process as disclosed in Japanese Pat. Nos. 33-6498, 49-32052 and 54-3926 as well as in our Japanese Patent Application Nos. 53-132252 and 53-137098. In any of these proposals, the strength to be provided to veneer sheets is basically determined by the strength with which a cord engages in the cuts of the veneer sheets. Another known type of process employs a adhesive in combination with a cord. A problem involved in this combined process is that, because a substantial period of time is necessary for the adhesive to produce an expected degree of strength, the adhesive in many cases fails to harden in time for a reeling operation which will follow the cord burying process. Then a veneer sheet is apt to be wound on a reel at a time when it is too early for the bonding strength of the adhesive to develop in addition to the veneer strength resulted from the cord. In any case, veneer sheets joined together with the aid of a cord and/or an adhesive tend to become disjoined by a load which will act on the veneer sheets during reeling operation. This frequently occurs also in the course of unreeling operation. Thus, the prior art methods cannot make the most of the reinforcing effect obtainable by burying a cord in veneer sheets. This is attributable to the fact that a cord slips out of the cuts of veneer sheets very easily when subjected to a load during reeling or unreeling. In other words, the cord burying, veneer reeling and unreeling steps are performed in the prior art without taking their inherent characteristics into consideration.

SUMMARY OF THE INVENTION

It is an object of the present invention to provide a method of reeling and unreeling a veneer sheet which employs a favorable interrelationship between the cord burying step, reeling step and unreeling step while duly considering the characteristics of cord-buried veneer sheets and load characteristics of the veneer sheet in reeling and unreeling steps.

In order to realize the above object, there is provided a method of reeling and unreeling a reinforced veneer sheet comprising the steps of forming at least one elongated cut in a selected one of two sides of a veneer sheet across its grain; embedding a length of cord in said grain to reinforce the veneer sheet; winding said reinforced veneer sheet onto a reel such that said cut side faces radially outward; and unwinding said wound veneer sheet off the reel such that said cut side faces downward, whereby said length of sheets acts to tightly hold the sheet on the reel during the winding step and maintain its engagement in the cut by supporting the veneer from below during the unwinding step.

DETAILED DESCRIPTION OF THE PREFERRED EMBODIMENTS

Figure 4:
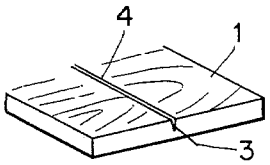
FIGS. 4–6 are fragmentary perspective views of different veneer sheets having cords buried therein; and FIGS. *7a–10b* indicate different examples of reeling and unreeling methods for a veneer sheet with a cord buried in its cut.
Figure 5:
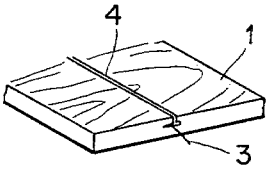
Figure 6:
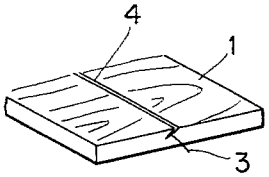

Referring first to FIGS. 4–6, there are shown three different examples of a veneer sheet 1 having a length of cord 3 embedded in an elongated cut 4 formed therein across the grain. The cut 4 is shown to have a V-shaped cross-section in FIG. 4, an inverted T-shaped cross-section in FIG. 5 and an inclined V-shaped cross-section in FIG. 6. As will be noticed, the cord in the cut 4 indicated in FIG. 5 is positioned in one of the horizontal bottom sections of the inverted "T". Raising the embedded cord 3 toward the surface of the veneer sheet 1 having the cut 4 will permit the cord to relatively easily slip out of the cut 4 overcoming the friction between the cord 3 and veneer sheet 1 in the case of FIGS. 4 and 6 or overcoming the shearing strength of the veneer sheet in the case of FIG. 5.

Taking such veneer sheets 1 for example, particularly the veneer sheet 1 of FIG. 4, a method according to the invention will be described with reference to FIGS. *7a–10b* which illustrate some examples of the combination of a cord burying step, a reeling step and an unreeling step. In each of FIGS. *7a–10b*, a veneer sheet being reeled and unreeled is shown in side elevation. Arrows depicted along the veneer sheets 1 indicate the directions of their movement. In each of the figures, the veneer sheet 1 is shown in section on one side of the illustration wherein arrow A indicates the side of the veneer sheet 1 on which the cut 4 and cord 3 are present. This specific surface of the veneer sheet 1 in each of FIGS. *7a–10b* will be referred to as the "A-side" hereinafter.

What should be paid attention to in FIGS. *7a–10b* is the position of the A-side of the veneer sheet 1 having the cord and cut thereon at the steps of winding and unwinding. In the example of FIGS. *7a* and *7b* for example, the cord embedding step, winding step and unwinding step are related such that the A-side of the veneer sheet 1 appears as the upper side in the cord embedding step, the inner side in the winding step and the lower side in the unwinding step.

In summary, the positions of the A-side in each of the examples shown in FIGS. *7a–10b* may be tabulated as shown below.

Figure 7A:
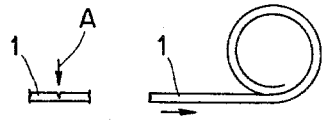
Figure 7B:
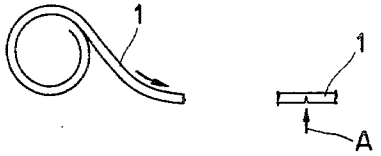

| | CORD EMBEDDING STEP | WINDING STEP | UNWINDING STEP |
|---|---|---|---|
| FIGS. 7a, 7b | upper side | | |
| | upper side | inner side | lower side |

-continued

Figure 8A:
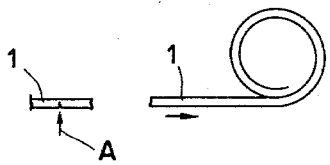
Figure 8B:
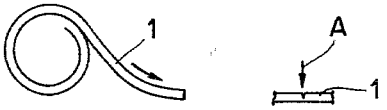
Figure 9A:
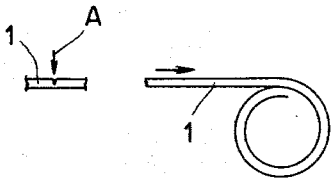
Figure 9B:
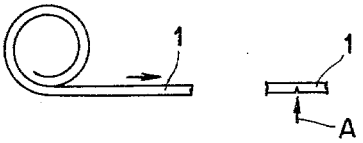
Figure 10A:
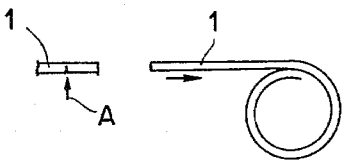
Figure 10B:
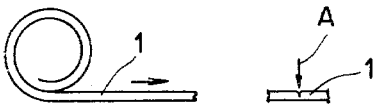

| | CORD EMBEDDING STEP | WINDING STEP | UNWINDING STEP |
|---|---|---|---|
| FIGS. 8a, 8b | lower side | outer side | upper side |
| FIGS. 9a, 9b | upper side | outer side | lower side |
| FIGS. 10a, 10b | lower side | inner side | upper side |

The veneer reeling and unreeling method according to the present invention employs the procedure shown in FIGS. 9*a* and 9*b* and it will offer effects as discussed hereinafter.

As seen from the table shown above, the veneer sheet 1 in FIGS. 9*a*–9*b* is embedded with the cord with its A-side faced upward, wound onto a reel with the A-side facing radially outward and unwound with the A-side facing downward. During winding and unwinding, a centrifugal force acting on the veneer sheet 1 tends to move it outward. However, the cord on the A-side tightly holds the veneer sheet 1 on the reel and gets into the cut with an additional strength thereby rendering the winding operation very stable. Also, said action of the cord adds to the intensity of gripping engagement between the cord and cut on the veneer sheet whereby the strength of the veneer sheet itself is increased.

The effects mentioned are obtainable in the same way with the procedure illustrated in FIGS. 8*a*. In FIGS. 7*a* and 10*a*–10*b* on the other hand, the cords 1 act during winding and unwinding in the opposite manner to the cords in FIGS. 8*a* and 9*a*–9*b*. Generally, where the rotation of a roll of veneer is intermittent, it is unavoidable in practice that trouble develops to generate and increases a tension in the cord in the veneer sheet. Suppose that synchronization has failed in the course of winding operation to cause such trouble that cracks the veneer sheet 1. Then a tension naturally develops in the cord in case where, for example, the cord is embedded in the veneer sheet 1 in a continuous way. Under this condition, the cord in FIGS. 7*a*–7*b* or 10*a*–10*b* will fully come out of the cut in the veneer sheet 1 at a position where the flat veneer sheet turns into a roll or, if remained within the cut, it will rise from the bottom of the cut to significantly limit the strength of the veneer sheet obtainable. This problem will grow more serious if the cord slipped out of the cut is caught by some element of the machine as frequently occurs because such an element will then pick the cord out of the cut continuously as conveyance of the veneer sheet 1 proceeds. In contrast, the cord in FIG. 8*a* or 9*a* avail itself of such a condition by eating into engaging the cut more strongly; what will occur in the worst case is a mere cut-off of the cord at one portion thereof, preventing the other portions of the cord from getting out of the cut. By relating the cord embedding step and winding step to each other, it will be appreciated that positioning the A-side of the veneer sheet 1 on the radially outer side of the veneer roll allows the two different steps to be improved, not only promoting efficient winding actions but affording the cord-buried veneer sheet itself a favorable effect. Concerning the relation between the position of the A-side and unwinding step, the cord in the procedure of FIG. 8*b* bears the weight of the veneer sheet 1 by suspending the veneer sheet with only its engaging strength with the cut whereas the procedure in FIG. 9*b* causes the cord to support the weight of the veneer sheet 1 from below with the strength thereof. Accordingly, during unwinding step, the cord in FIG. 8*b* tends to be released from the cut of the veneer sheet while the cord in FIG. 9*b* tends to more strongly engage the cut of the veneer sheet. This difference is as significant as the difference discussed in connection with the winding step. The veneer roll shown in FIGS. 8*a*–8*b* may be turned 180° to invert the positional relationship between the winding and unwinding steps or it may be in order to unwind the veneer sheet in the opposite direction so as to cause the A-side to face downward during unwinding as in the case of FIG. 9*b*.

As will be seen from the above, the principle of the present invention consists in establishing the described relationship between the cord embedding step, winding step and unwinding step so that the three different steps proceed in an intimately related way and assist each other to enhance the individual effects. While the cord embedding step has been shown and described as employing a cord alone to be embedded in a cut of a veneer sheet, it will be noted that said process may use an adhesive in combination with a cord if desired.

Figure 1:
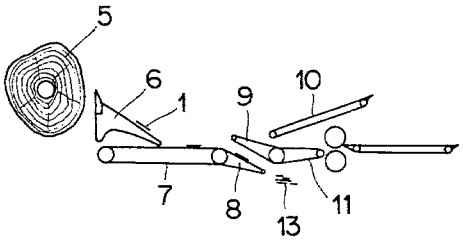
FIGS. 1–3 illustrate in side elevation three different conditions of an apparatus for practicing the method according to the present invention.
Figure 2:
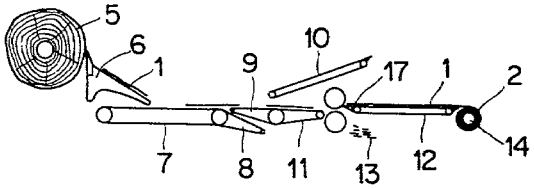
Figure 3:
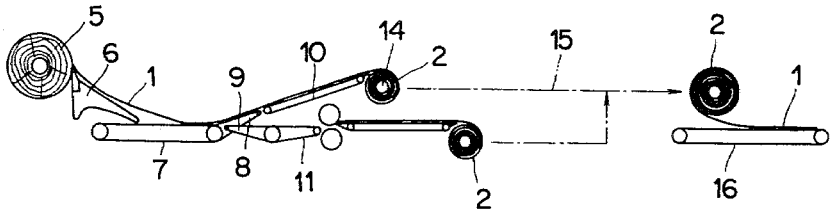

Reference will now be made to FIGS. 1–3 for describing an example of a veneer sheet processing line which includes a veneer lathe and an arrangement embodying the principle method of the present invention discussed hereinabove.

Referring to FIGS. 1–3, the veneer processing line comprises a veneer lathe having a reciprocatable tool support 6 having a knife thereon for cutting off a veneer sheet from a log 5, a cutting machine with a blade 17 for removing defective portions from veneer sheets to prepair trimmed sheets, a reeling device for winding a veneer sheet onto a reel 14, and an unwinding device which receives a veneer roll wound on the reel 14 brought thereto through a transfer path 15 and then unreels it onto a conveyor 16. FIG. 1 shows an initial stage of a log cutting operation wherein veneer sheets cut off from the log 5 are disposed of as unavailing chips 13 through cooperating conveyors 8 and 9 then having the illustrated relative position. As the tool support 6 advances as shown in FIG. 2, it produces veneer sheets containing defective portions from the log 5 while the conveyor 9 is brought to its closed position relative to the conveyor 8 to bridge first and second conveyors 7 and 11. Then the blade 17 removes the defective portions of the sheets as chips 13 whereafter the thus trimmed sheets are carried by a fourth conveyor 12 and successively wound up onto the reel 14 to form a veneer roll thereon. As the tool support 6 further advances, a continuous strip of veneer is cut off from the log 5 and the conveyor 8 now bridging the first and third conveyors 7 and 10 as illustrated moves the continuous veneer sheet toward a reel 14 causing it to be taken up thereon. After the roll of veneer 2 on the reel 14 is transferred through the path 15 to the unreeling device and unreeled onto the conveyor 16, a new reel is supplied to receive succeeding sheets.

With this arrangement, the veneer processing method according to the present invention is practiced as follows. In the cutting stage shown in FIG. 2, the fourth conveyor 12 is driven intermittently to suitably put the dimensioned sheets 1 close at a position downstream of the cutting edge of the blade 17 while a cord is intermittently embedded in the sheets 1 from above. In suitably synchronized relation with such actions, the sheets 1 are taken up on the reel 14 with their lower sides faced inward, that is, surfaces having cord embedding cuts faces radially outward so as to form the veneer roll 2.

As a continuous veneer strip 1 is cut off from the log 5 as indicated in FIG. 3, the strip or sheet 1 is wound onto another reel 14 but, in this case, it has already been embedded with a cord by the veneer lathe. In other words, the cord is continuously embedded in the log before the peeling off of the veneer sheet. Again, this cord embedding step at the veneer lathe occurs with the A-side of the veneer sheet 1 having a cut and a cord facing upward while the winding step proceeds with the A-side facing radially outward. As viewed in FIG. 3, the veneer roll 2 will be unwound from the reel 14 onto the conveyor 16 with its A-side facing downward. The procedure for burying a cord in a veneer sheet and that for burying a cord in the same at a veneer lathe are not shown in the drawings since their known techniques such as those disclosed in Japanese Patent Publications and Applications mentioned in connection with the background of the invention.

There has been a demand in relation with the cutting process of a veneer lathe for properly synchronizing the operating speeds of the veneer lathe and its associated devices for veneer processing while maintaining a high speed operation as a whole. This demand, however, has been so difficult to be met. Despite that some methods for burying cords in veneer sheets at a veneer lathe have been proposed as disclosed in Japanese Pat. No. 35-4246, none of them have been put to practice yet. Whereas, the present invention provides a drastic improvement which lessens the difficulties and realizes a cord burying process at a veneer lathe. This will surely make significant contribution to a future veneer processing method whose major process is the cord burying process. Additionally, a veneer lathe capable of producing a tenderized veneer sheet while cutting if off from a log permits the veneer sheet to be readily reeled with its lower side facing inward.

While the present invention has been shown and described as burying a cord in a veneer sheet 1 at the veneer lathe when it is produced in the form of a continuous strip, an alternative design is possible in which the conveyor 8 remains in its closed position (FIG. 2) a continuous sheet is embedded with a cord downstream of the blade 4 and then is wound onto the reel 14 thereafter.

What is claimed is:

1. A method of reeling and unreeling a reinforced veneer sheet comprising the steps of (1) forming at least one elongated cut in a selected one of two sides of a veneer sheet across its grain;

(2) embedding a length of cord in said elongated cut to reinforce the veneer sheet;

(3) winding said reinforced veneer sheet onto a reel having an axis such that said cut side faces radially outward relative to the axis of the reel; and (4) unwinding said wound veneer sheet off the reel such that said cut side faces downward relative to the surface of the earth, whereby said length of cord acts to tightly hold the sheet on the reel during the step (3) and maintain its engagement in the cut by supporting the veneer from below during the step (4).

2. A method according to claim 1, wherein said cut forming step and cord embedding step is intermittently performed after said veneer sheet is subjected to a defective portion trimming step.

3. A method according to claim 1, wherein said cut forming step and cord embedding step is continuously performed on a log before said veneer sheet is peeled off from said log.

4. A method according to claim 1, wherein said selected side of the veneer sheet includes an upper side thereof and said winding step is performed by passing the sheet over an upper area of the reel periphery relative to the surface of the earth and said unwinding step is performed by pulling out the sheet from a lower area of the reel periphery relative to the surface of the earth.

* * * * *